US005769655A

United States Patent [19]

Tsai

[11] Patent Number: 5,769,655

[45] Date of Patent: Jun. 23, 1998

[54] C-TYPE LIGHT BULB SOCKET STRUCTURE

[76] Inventor: Chin-Sung Tsai, No. 65, Shien-cheng 11 Street, Chupei, Hsinchu Shien, Taiwan

[21] Appl. No.: 634,578

[22] Filed: Apr. 18, 1996

[51] Int. Cl.[6] ..... H01R 4/24

[52] U.S. Cl. ..... 439/419

[58] Field of Search ..... 439/419, 340

[56] References Cited

U.S. PATENT DOCUMENTS 5,380,215 1/1995 Huang ..... 439/419

5,586,904 12/1996 Huang ..... 439/419

*Primary Examiner*—Gary F. Paumen

*Attorney, Agent, or Firm*—Morton J. Rosenberg; David I Klein; Jun Y. Lee

[57] ABSTRACT

A C-type light bulb socket structure is provided which has improved conducting plates. The conducting plates each have a pair of arms that are engaged within a respective opening formation in the socket. The socket has a T-shaped projection for engagement with a U-shaped end of the negative conducting plate. The negative conducting plate is slightly arched to provide a good electrical contact with the light bulb when such is assembled thereto.

2 Claims, 7 Drawing Sheets

C-TYPE LIGHT BULB SOCKET STRUCTURE

BACKGROUND OF THE INVENTION

In the prior art, a C-type light bulb socket structure for use in engaging a large bulb is known. Such prior art systems use a large conducting plate in the socket for contact with the base of the bulb, which is mounted in the socket. Obviously, a large conducting plate is easily loosened before being engaged with the bulb, due to its weight. That condition causes problems.

SUMMARY OF THE INVENTION

In view of the above drawback, the primary object of the present invention is to provide a C-type light bulb socket having improved conducting plates which can be firmly engaged within the socket.

Another object of this invention is to provide an improved C-type light bulb socket having a catch element which can be used for engaging the end of a clamp formed on the cap that is mounted on the socket. The socket together with the cap and the bulb are thereby able to be hung on another fixed object without loosening.

The structure and features of the present invention will be now described in detail with reference to the accompanying drawings.

DETAILED DESCRIPTION OF A PREFERRED EMBODIMENT

Figure 1:
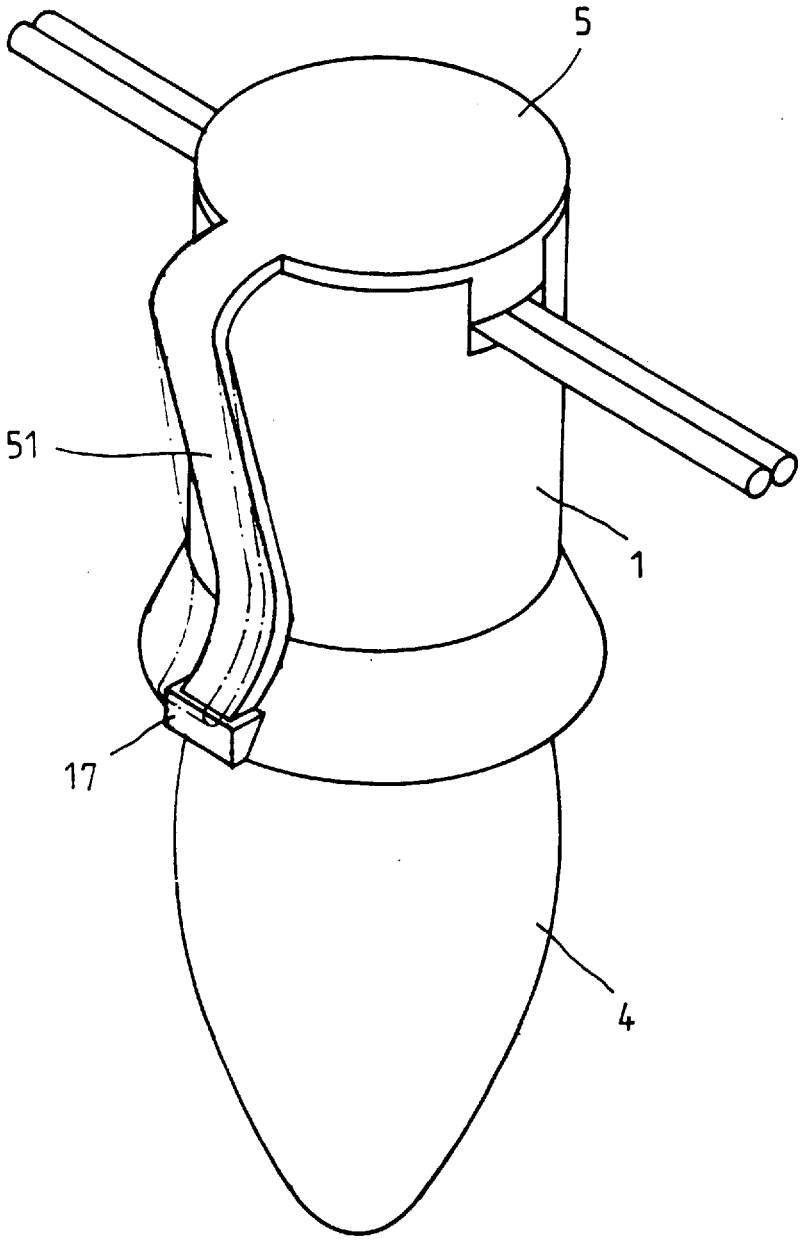
FIG. 1 is a perspective view of a C-type light bulb socket according to the present invention.
Figure 2:
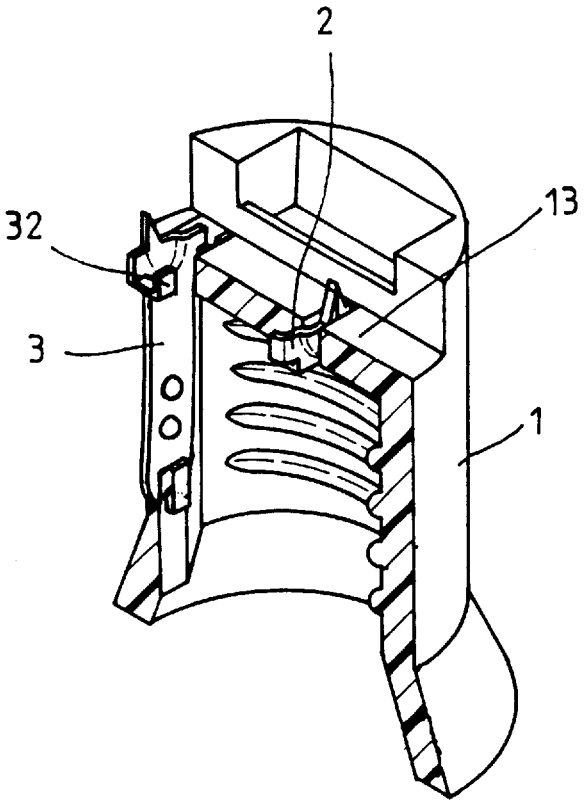
FIG. 2 is a perspective view, partially sectioned, of the socket according to the present invention.
Figure 3:
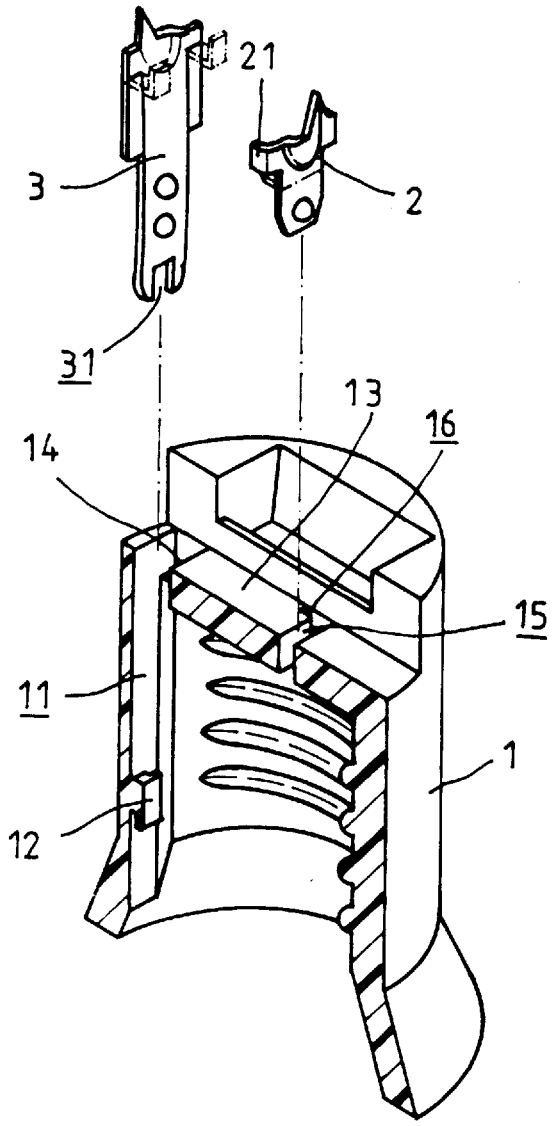
FIG. 3 is an exploded view, partially sectioned, showing the socket of FIG. 2.
Figure 6:
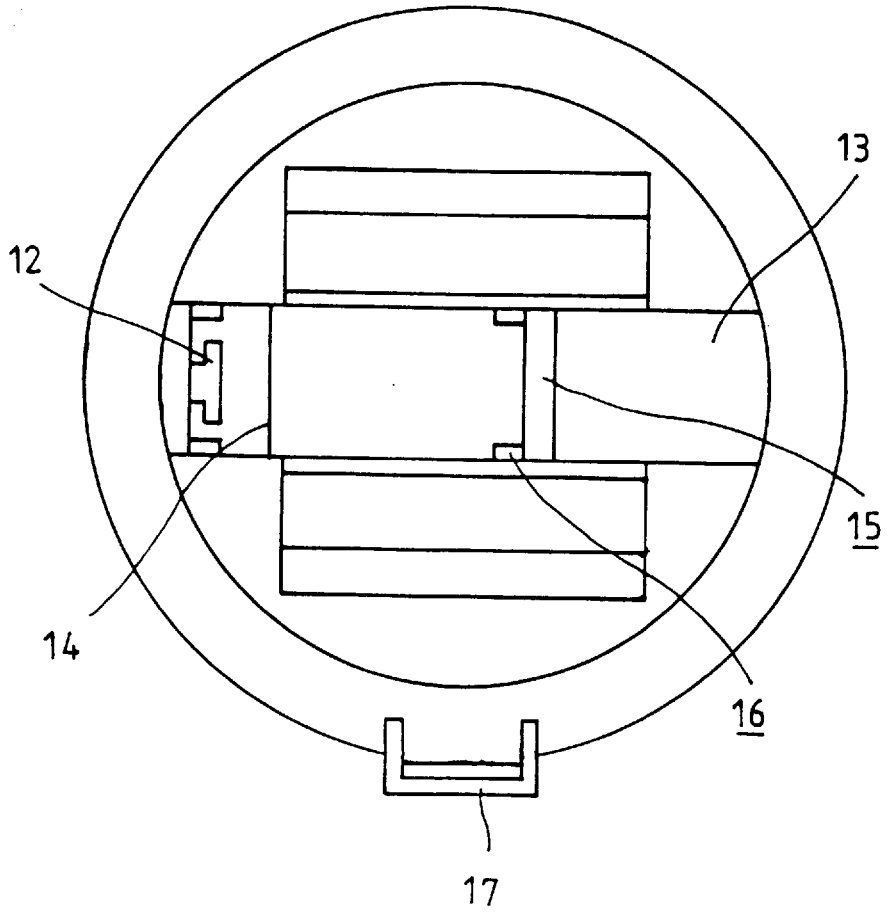
FIG. 6 is a top plan view of the socket according to the present invention; and, FIG. 7 is another top plan view of FIG. 6 after engagement with the conducting plates.
Figure 7:
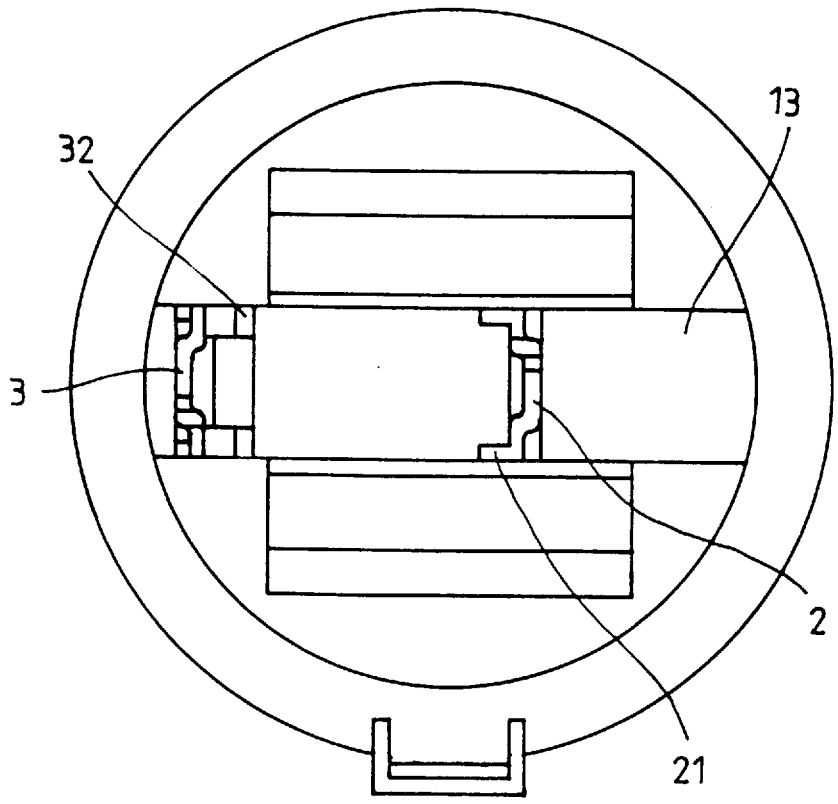

Referring to FIGS. 1 to 3, the light bulb socket of the present invention includes a socket 1, and a cap 5, into which a bulb is received. A central conducting plate 2 and a side conducting plate 3 are engaged within the socket 1. A groove 11 is formed longitudinally in the inner surface of the socket 1 to receive the side conducting plate 3 therein. A T-shaped projection 12 is formed at the longitudinal end of the groove 11 for engagement by a U-shaped end 31 of the side conducting plate 3. The side conducting plate 3 has a pair of arms 32 at one end thereof that are bent in a U-shaped configuration. After the side conducting plate 3 is engaged within the socket 1, the arms 32 are retained in a hole 14 formed in the head portion 13 of the socket 1. Due to an elastic force provided by the bent arms 32, the side conducting plate 3 is firmly engaged within the socket 1. The center of the head portion 13 of the socket 1 is formed with a slot 15 having two transversely directed openings 16. The central conducting plate 2 has a pair of curved arms 21 at one end thereof. The conducting plate 2 is inserted into the slot 15 of the head portion 13 of socket 1. The two curved arms 21 are respectively positioned in the two transverse openings 16. In this manner, the central conducting plate 2 can be assembled to the socket 1 securely, as shown in FIGS. 6 and 7. By that structure an improvement is obtained, wherein the central conducting plate 2 is prevented from loosening in the slot 15 of the socket 1.

Figure 4:
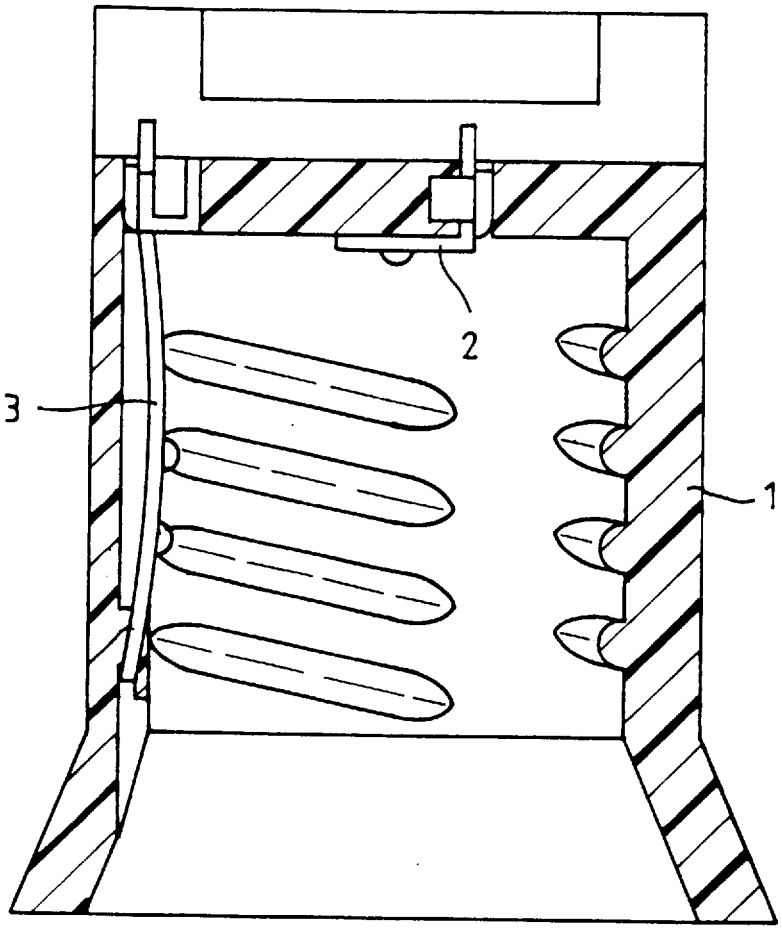
FIG. 4 is a cross-sectional elevation view of the light bulb socket of the present invention.
Figure 5:
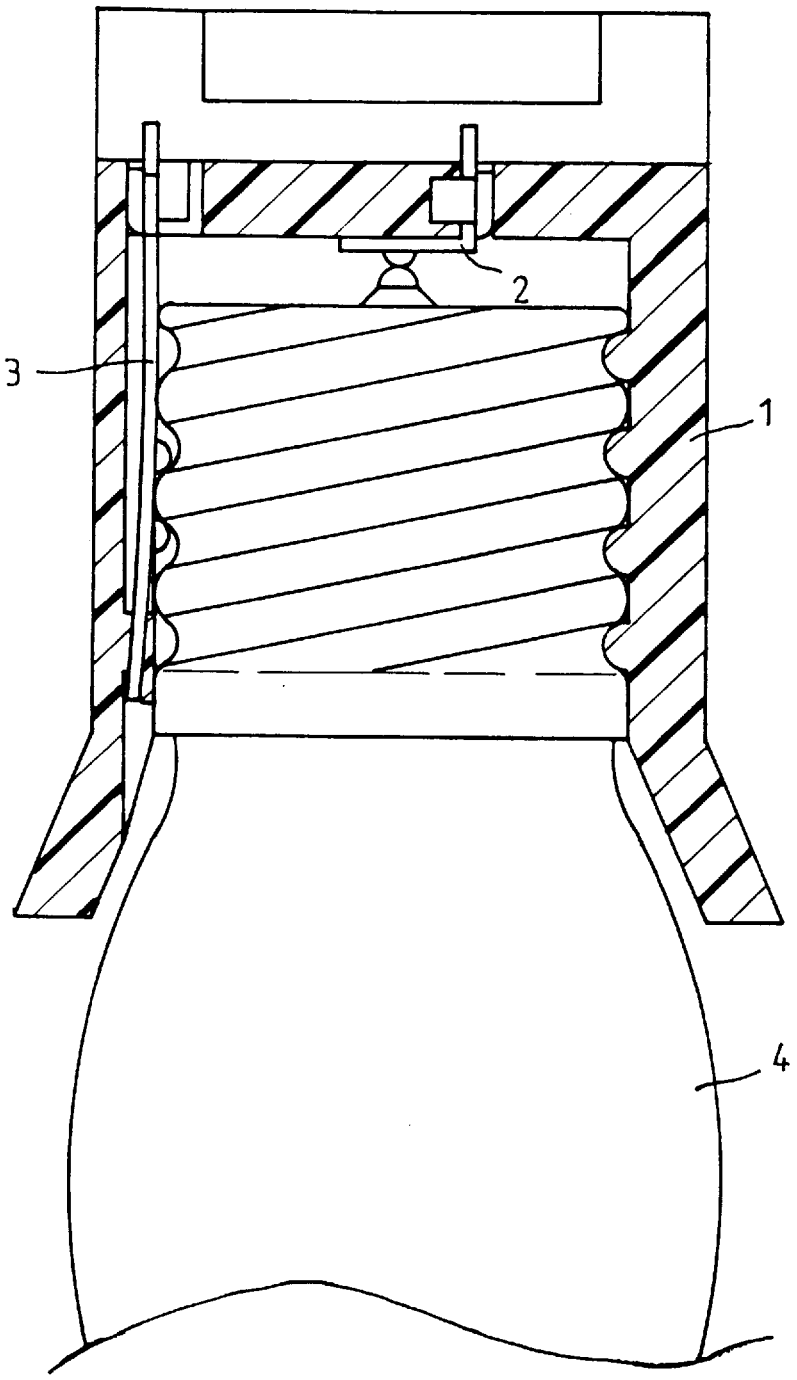
FIG. 5 is another cross-sectional elevation view of the present invention with a light bulb installed.

Another characteristic of the present invention is that the side conducting plate 3 will be slightly arched. When the bulb 4 is connected to the socket 1, the sides of the bulb 4 will press against the side conducting plate 3 and thereby make a good electrical contact therewith, as shown in FIGS. 4 and 5.

Moreover, a catch 17 is formed on a side of the socket 1, as shown in FIG. 1. It is known to provide a clamp on conventional C-type light bulb sockets so that they can be hung on another object, such as a stick or a wire. Like the conventional socket, the present invention has a clamp 51 formed on the cap 5, which is connected to the socket 1. The end of the clamp 51 can be engaged within the catch 17 of the socket 1, so that the C-type light bulb socket structure of the present invention will be more securely hung from an object.

I claim:

1. A C-type socket structure for coupling to a light bulb, comprising:

a socket having a longitudinally extending cylindrical wall and a bottom wall, said socket having (1) a longitudinally extended groove formed in an internal surface of said cylindrical wall, (2) a T-shaped projection formed at a bottom end of said groove, (3) a hole formed through said bottom wall in alignment with said groove, (4) a slotted opening formed centrally in said bottom wall, and (5) a pair of transverse openings formed on opposing ends of said slotted opening;

a side conducting plate disposed in said groove and having an arched contour, said first conducting plate having a U-shaped end for engagement of said T-shaped projection and a pair of arms formed on an opposing end thereof, each of said pair of arms being bent in a U-shaped configuration for engagement within said hole in said bottom wall;

a central conducting plate extending through said slotted opening in said bottom wall, said central conducting plate having a pair of curved arms formed on one end thereof, said pair of curved arms being respectively positioned in said pair of transverse openings for securing said central conducting plate therein; and, a cap coupled to said bottom wall in overlaying relationship with an external surface thereof.

2. The C-type socket structure as recited in claim 1 where said cap has a clamp extending therefrom and said socket has a catch formed on an external surface of said cylindrical wall for engagement with a distal end of said clamp.

* * * * *